United States Patent [19]

Aragon

[11] Patent Number: 4,875,988

[45] Date of Patent: Oct. 24, 1989

[54] ELECTROLYTIC CELL

[76] Inventor: Pedro J. Aragon, 306 Highpoint Dr., Wadsworth, Ohio 44281

[21] Appl. No.: 229,603

[22] Filed: Aug. 5, 1988

[51] Int. Cl.[4] ..... C25B 9/00; C25B 11/03; C25B 13/06; C25B 13/08

[52] U.S. Cl. ..... 204/265; 204/266; 204/283; 204/284; 204/295; 204/296

[58] Field of Search ..... 204/252–258, 204/263–266, 295, 296, 282–283

[56] References Cited

U.S. PATENT DOCUMENTS

| | | | |
|---|---|---|---|
| Re. 30,864 | 2/1982 | Justice | 204/98 |
| 571,591 | 11/1896 | Hargreaves | 204/295 |
| 636,142 | 10/1899 | Hodgson | 204/295 |
| 3,022,244 | 2/1962 | LeBlanc | 204/266 |
| 3,351,542 | 11/1967 | Oldershaw | 204/149 |
| 3,379,634 | 4/1968 | Rutkowski | 204/258 |
| 3,458,414 | 7/1969 | Crane | 204/149 |
| 3,563,879 | 2/1971 | Richards | 204/272 |
| 3,669,857 | 1/1972 | Kirkham | 204/51 |
| 4,029,565 | 6/1977 | Bender et al. | 204/266 X |
| 4,124,478 | 11/1978 | Tsien et al. | 204/255 |
| 4,129,493 | 12/1978 | Tighe | 204/228 |
| 4,136,005 | 1/1979 | Persson | 204/266 |
| 4,149,952 | 4/1979 | Sato | 204/258 |
| 4,196,068 | 4/1980 | Scoville | 204/256 X |
| 4,263,119 | 4/1981 | Mose | 204/257 |
| 4,381,240 | 4/1983 | Russell | 210/746 |
| 4,409,074 | 10/1983 | Iijima | 204/98 |
| 4,432,860 | 2/1984 | Bachot | 204/296 |
| 4,493,760 | 1/1985 | Bianchi | 204/278 |
| 4,496,452 | 1/1985 | Bianchi | 204/266 |
| 4,541,911 | 9/1985 | Burgess et al. | 204/297 R X |
| 4,574,037 | 3/1986 | Samejima | 204/98 |
| 4,613,415 | 9/1986 | Wreath | 204/98 |
| 4,627,897 | 12/1986 | Tetzlaff | 204/59 |
| 4,767,511 | 8/1988 | Aragon | 204/128 |

*Primary Examiner*—Donald R. Valentine

[57] ABSTRACT

Disclosed is an improved electrolytic cell comprising a microporous separator of the diaphragm type, anolyte and catholyte compartments made of plastic materials and metal electrodes with a multipicity of perforations in the electrochemically active area made preferentially by punching perforations of pre-selected shapes. Also disclosed is the presence of a separation chamber located on top and being an integral part of the anolyte compartment for separating the anodic gases from the expent anolyte solution. Also disclosed are methods for mounting and sealing all of the elements of the electrolytic cell that allow for differences in the thermal expansion of the metal and plastic parts. Further disclosed is a method for attaching together several cells to form a stack, where the cells within the stack can be connected in series or in parallel.

12 Claims, 3 Drawing Sheets

ELECTROLYTIC CELL

This invention relates to electrolytic cells and more particularly to cells with plastic bodies and perforated metal electrodes.

BACKGROUND ART

Electrolytic cells can be used, in principle, for the electrolytic production of any amount of chemicals. However, with the present limitations in the state of the art, it is difficult to fabricate large-sized equipment made of plastic materials at low cost. However, some small size electrolytic cells can be found in water treatment systems for swimming pools.

Most of the electrolytic cells developed for the chlor-alkali industry are for production of large capacities on the order of many tons of chlorine per day.

The cell described herein is not limited to the production of chlorine, hydrogen and caustic soda, but could be easily adapted to the production of any other chemicals that require an electrolytic cell equipped with a separator.

The need for small electrochemical production units is now amply justified. Problems with storage and handling of dangerous chemicals like chlorine and caustic soda have been growing as more regulations to protect workers and the environment are being demanded by the population at large. Chlorine production for small installations such as cooling water towers for hotels and hospitals, fresh and waste water disinfection, and medium and large swimming pools will certainly benefit by on-site production. Beside producing only the amount needed at the time needed, there will be considerable savings in transportation costs, including insurance. No less important is to reduce the frequency and amount of dangerous chemicals being transported over long distances. The possibility of accidents occurring on the highways or on the rail tracks during transportation of these dangerous chemicals has become a reality as many countries shift to giant industrial plants with low production costs.

FUNCTIONS OF A SEPARATOR IN ELECTROLYTIC CELLS:

Separators in electrolytic cells are a necessity when the mixing of the anolyte and catholyte solutions and/or the products of the reaction must be avoided. This need can also be extended to those cases when, for specific reasons, the catholyte and the anolyte solutions are different. In these cases, as for example in the production of chlorine from brine solutions, a separator must be installed in between the anode and cathode to avoid the above mentioned mixing. However, the presence of a separator adds to the voltage drop between the two electrodes by: a) introducing a material that has a higher specific resistivity than the electrolyte itself, and b) this separator, no matter how thin it is, adds to the distance between the two electrodes and thus, to the resistance between them.

Diaphragms: In the electrolytic production of chlorine, one of the most used separators is being made of different compositions of asbestos based materials. These devices, usually called diaphragms, have high specific porosity and therefore allow a large flow of electrolyte solution through them. Since, in most of the industrial electrolytic chlorine plants, the efficiency of the plant is measured by the amount of chlorine gas produced with respect to the electrical energy consumed, the cell must be designed in such a way as to minimize the possible causes of reduction in the efficiency of chlorine production. One important factor to consider is the migration of hydroxil ions, through the diaphragm, to the metal anode to react and form oxygen gas. Also the hydroxil ions can react with the chlorine gas being generated on the anode electrode to form hypochlorite ions, further reducing the production of chlorine gas. These possibilities are considerably reduced by forcing the circulation of brine (that enters into the cell through an opening in the anode compartment) through the diaphragm into the cathode compartments as mentioned by Mose, et al, in U.S. Pat. No. 4,263,119 and by LeBlanc, et al, in U.S. Pat. No. 3,022,244. Once into the cathode compartment, the chlorine saturated solution of brine reacts at the cathode surface and hydrogen gas is generated. The evolution of hydrogen gas changes the chemical equilibrium and results in the formation of caustic soda. Part of this caustic soda reacts with the dissolved chlorine coming in the brine from the anolyte compartment, to form sodium hypochlorite and chlorates. This caustic soda solution, known in the chlor-alkali industry as the "cell liquor", leaves the cell through an opening generally located at the top of the cell. The hydrogen gas may have a separated outlet, although it generally does not.

The usual method for forming an asbestos diaphragm is to apply it as a slurry, under vacuum, to the surface of the cathode electrode and to then dry or cure the diaphragm with heat in special ovens. This practice requires special diaphragm installation facilities and is time consuming. Therefore, in a chlor-alkali cell, the use of diaphragms of the asbestos type has the following advantages and disadvantages: Advantages: (1) Low cost of the base materials, (2) ease of installation, and (3) ease of forming the diaphragm onto complicated electrode configurations. Disadvantages: (1) The inherent risk of handling asbestos fibers, (2) loss of the chlorine, or other anodic gases, dissolved in the expent anolyte solution and carried through the diaphragm to the catholyte compartment where it reacts with the caustic, (3) the chlorine that reacts with caustic forms sodium hypochlorite and sodium chlorates that are highly corrosive, (4) the catholyte solution leaving the cell must be sent to crystallizers in order to separate the caustic from the salt (NaCl) and concentrate the caustic solution to the required values for commercialization, (5) these crystallizers are very expensive, having to be made of very corrosion resistant materials (generally nickel or nickel-chromium alloys) in order to stand the rigors of high temperature and the presence of hypochlorites and chlorates, and (6) the cost of having to build a diaphragm deposition and curing facility must be taken into consideration.

Because there has not been a better technical solution and despite all these problems, asbestos based diaphragms have been and still are being used commercially in many chlorine plants around the world.

Membranes: During the last ten years a new separator, made by chemically modifying the surface of halocarbon films, has become the separator of choice for many new cell designs. These materials can be classified within the group of "ion-selective permeable membranes" or "permionic membranes" or simply: "membranes". The advantages and disadvantages of such membranes are as follows. Advantages: (1) These new membranes have allowed designers to build the so called close-gap configurations, where the distance between the anode and cathode is minimum, (2) the ion-selectivity of these membranes allows only the diffusion of sodium and hydrogen ions, therefore the caustic produced can (a) be almost free from hypochlorites, salt, and chlorates, and (b) the caustic concentration, at the cell outlet, can reach (under the present state of the art) up to 35%, (3) the introduction of these membranes and the construction of "flat-parallel" thin cells has allowed the stacking of many of these unitary cells to form units with just about any production capacity that is required, and (4) their specific resistivity is low. Disadvantages: (1) Their price is relatively high, (2) under certain circumstances they can "tear-open" with the possibility of catastrophic failure, (3) their installation is time consuming and requires specialized personnel for handling, (4) frequently, these membranes expand during operation with the formation of "wrinkles" that erode the surface of the electrodes with some damage to the catalyst present on the surface of these electrodes, and (5) their effective operating life is about two years.

For these reasons, the development of a cell that could use the best characteristics of both types of separator-related cells and low cost of manufacture and maintenance would constitute an important contribution to the electrochemical technology.

THE PLASTIC BODY IN ELECTROLYTIC CELLS

Many attempts have been made in the industry to develop plastic-bodied cells. Most of these attempts have not been successful for several reasons: (a) the materials used were not resistant to the environment under the operating conditions, (b) in order to achieve significant production/day/unit, some designs failed because the mechanical demands on strength and rigidity could not be met by plastics, (c) some other failed because the material selected could not be machined and/or formed according to complicated forms required, (d) because of the differences in the expansion coefficients, at the operating temperature, between the plastic cell body and the metal parts, ie. electrical connections and electrodes, it has been difficult to achieve an effective sealing of the cell and prevent leaks of fluid and/or dangerous gases, and (e) the costs associated with the fabrication of large size plastic structures or cell bodies have been too high.

The plastic body: The electrolytic cell object of this invention is a cell where the anolyte and catholyte compartments are made of plastic materials. For the purpose of this invention herein after, in the specifications and in the claims, plastic materials are those kind of materials that are electrical insulators, non-metallic substances, that can be laminated, extruded, kept in a permanent shape when formed in their plastic state, molded, poltruded, cut and welded or adhesively joined to form more complicated forms. The preferred materials are, without being exclusive: Chlorinated polyvinyl chloride (CPVC), polyvinyl chloride (PVC), polyhalogen hydrocarbons that can be welded to themselves, polypropylene, high density polyethylene, many fiber reinforced plastics (FRP's) chemically resistant to the combination of operating temperatures and chemical environment, and impervious chemically resistant ceramics. The plastic body (both, the catholyte and the anolyte compartments) of the present invention can be made by molding, poltruding, or by any other suitable technique for forming plastic materials.

DISCLOSURE OF THE INVENTION

In light of the foregoing it is a first aspect of the invention to provide an electrolytic cell whose main object is, besides the electrochemical reaction, the reduction of capital investment, maintenance and operational costs.

Another aspect of the invention is the provision of an electrolytic cell that could be discarded after its useful life.

Another aspect of this invention is to produce an electrolytic cell that can be joined with other similar cells to form a stack of cells where the cells and/or the stacks can be connected in parallel, series, or a combination of both, to best utilize the source of electrical power available.

The foregoing and other aspects of the invention which will become apparent as the detailed description proceeds, are achieved by an improved electrolytic cell having a catholyte and anolyte compartments made of impervious plastic materials, with indentations in their front surfaces for the mounting of flat, perforated, electrodes, and a microporous plastic separator which is positioned between the two electrodes. The electrodes and the separator are mounted onto the compartments by means of adhesive resilient materials.

DESCRIPTION OF THE DRAWINGS

For a complete understanding of the objects, techniques, and structure of the invention, reference should be made to the following detailed description and accompanying drawings wherein.

BEST MODE FOR CARRYING OUT THE INVENTION

Figure 1:
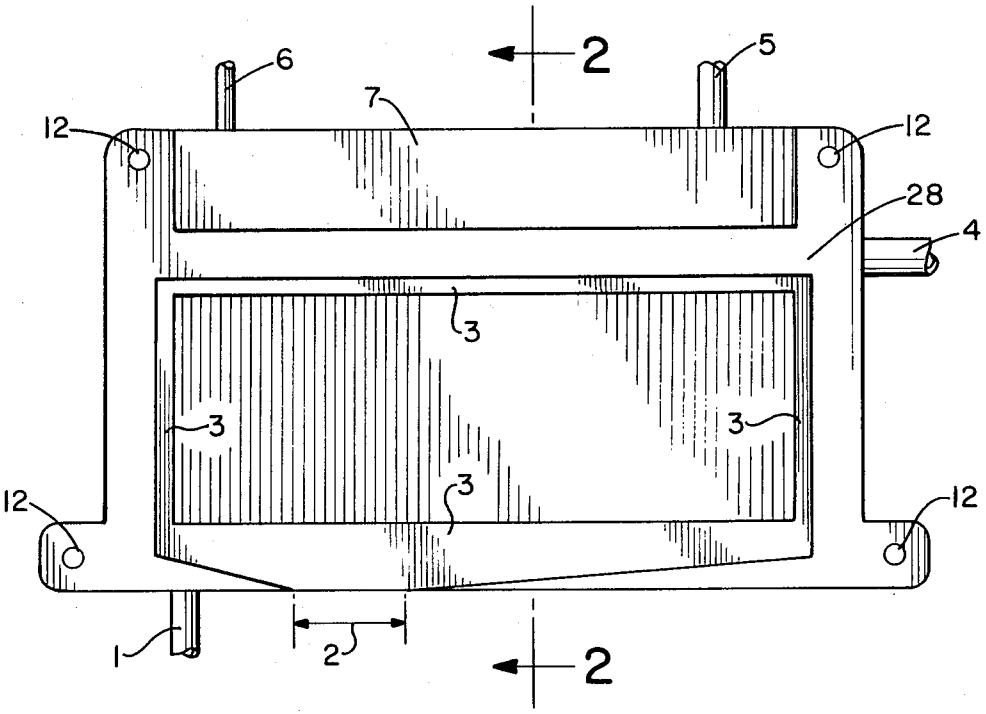
FIG. 1 is a plan view of the anolyte compartment, with the front surface to the viewer.

With reference now to the drawings, and more particularly FIG. 1 a view of the plastic anode compartment of the invention with the front surface 28 facing the viewer. At the bottom left of the figure the first conduit 1 for receiving a flow of fresh anolyte solution into the anolyte compartment is shown. Away from the first conduit, toward the center of the lower side of the anolyte compartment, the drawing shows the opening 2 to allow the protruding electrode connection tab to exit the compartment. Under the number 12 four perforations or holes are seen on extensions or ears of the body of the compartment located on the four corners of the anolyte compartment. These perforations have the purpose of allowing the passage of four bolts for holding together the two compartments and the rest of the cell components.

As can be seen in the drawing for the catholyte compartment, another set of four perforations are in alignment with the perforations in the anolyte compartment. These perforations have, on one of the compartments, called the first compartment, an enlargement located on the back surface of the compartment to allow for the the heads of the bolts to be flush with the back surface of the first compartment when the bolts are tightened. On the other compartment, called the second compartment, the perforations are threaded so the bolts can be screwed directly into these perforations. It is irrelevant which compartment holds the head or the end of the bolt. This bolting system allows the stacking together of several cells without the problem of any protruding part of the bolts to interfere.

The drawing also shows the indentation 3 made in the front surface of the anolyte compartment to allow for the mounting of the anode electrode plus a fraction of the thickness of the separator. The opening 2, located in the lower side of the anolyte compartment, is for allowing the electrode connection tab to exit the compartment. This opening is part of the indentation 3.

On the right side of the drawing, and identified by the numeral 4, the second conduit is located. This second conduit is for removing the expent anolyte solution from the anolyte compartment. The second conduit, as can be seen in the drawing, is also located immediately over the level corresponding to the top side of the anode electrode and is positioned on a side opposite that of the first conduit 1.

The separation chamber 7 is located on the top of the anolyte compartment and forms an integral part of it. This separation chamber crosses a separation plane between the anode and the cathode compartments to occupy a space available over the catholyte compartment and being flush to a plane of the back surface of the catholyte compartment once the cell is assembled. This separation chamber separates the anodic gas produced during the electrolysis from the expent anolyte solution which flows back under the force of gravity, and exits the anolyte compartment through the second conduit 4. Also located in the separation chamber is at least one outlet 5 for removal of the anodic gases produced during electrolysis and, at least one inlet 6, for receiving gases originated from outside of the electrolytic cell. This inlet 6 has three functions. For systems where the expent anolyte solution is stored in a tank; some of the dissolved gases are accumulated in the space existing above the surface of the liquid. Many times these accumulated gases are toxic and when the tank is opened for service, the presence of these gases could become threatening to the health of the operators. By connecting this space through the inlet 6 to the separation chamber 7 of the electrolytic cell, these gases will be swept through the cell and out of the system. This operation not only removes or reduces a potential danger, but also helps recuperate valuable gases that otherwise could be lost. Further, when the removal of the anodic gases is performed under vacuum, allowing a certain amount of gas from outside the cell to enter the separation chamber helps equalize the pressure in both the anolyte and the catholyte compartments. This pressure equalization reduces the possibility of producing a flow of catholyte solution through the separator to the anolyte compartment. Finally, when the electrolytic cell must be disassembled, prior to its opening a certain amount of air can be allowed to pass into the compartment in order to flush out any remaining noxious gases that may be present.

Figure 2:
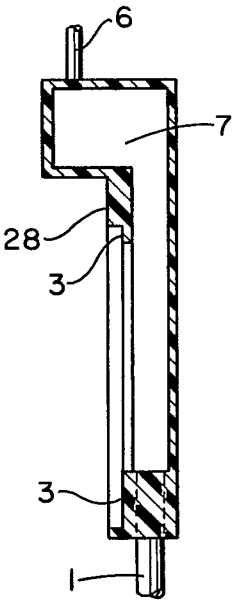
FIG. 2 is a cross section of the anolyte compartment through the line 2—2 in FIG. 1, showing the gas separation chamber at the top of the anolyte compartment.

FIG. 2 presents a cross section view of the anolyte compartment at the line 2—2 in FIG. 1. In this drawing the separation chamber 7 is seen projecting away from the front surface 28 of the anolyte compartment. The indentation 3 is for holding the anode electrode plus a fraction of the thickness of the separator. Also shown are the first conduit 1 and the outlet 5 for the anodic gases produced during the electrolysis plus any other gas that may have been admitted into the separation chamber through the receiving inlet 6. It is important to mention here that the indentation, either in the anolyte or catholyte compartment could be made deep enough as to accommodate the metal electrodes plus the whole thickness of the separator.

Figure 3:
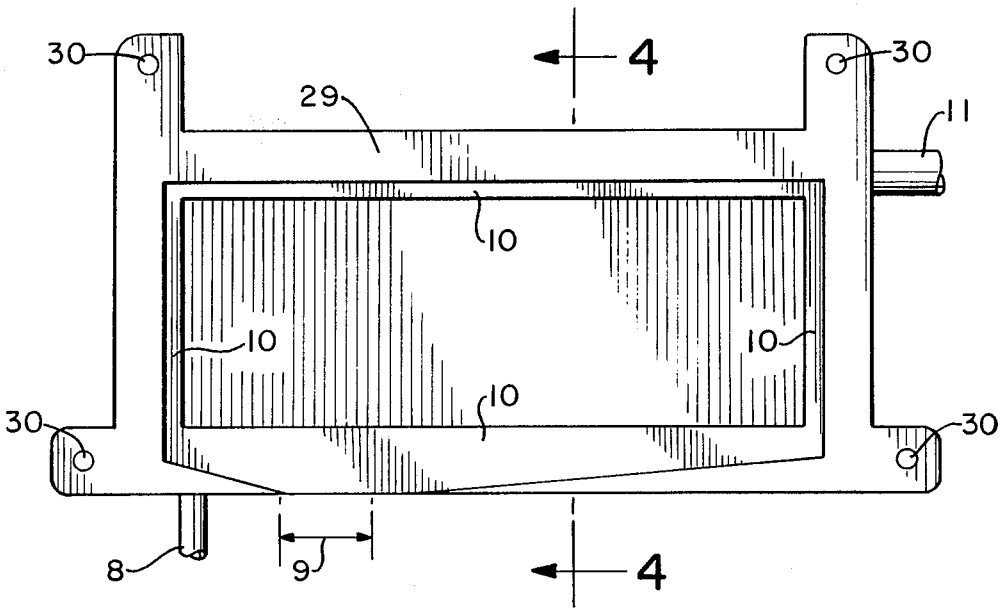
FIG. 3 is a plan view of the catholyte compartment, with the front surface to the viewer.

FIG. 3 illustrates the plastic catholyte compartment with the front surface 29 to the viewer. The third conduit 8 for receiving a flow of fresh catholyte solution is located at the bottom and next to the side of the catholyte compartment in such a way that when the electrolytic cell is assembled, the third conduit will be located on the opposite side to the first conduit. Towards the center and on the bottom of the compartment is located the opening 9 for the cathode electrode connection tab. On the opposite side to the third conduit, at the top of the catholyte compartment and slightly above the level of the top of the cathode electrode is the fourth conduit 11 for removing the catholyte fluid, which is a mixture of the cathode reaction products plus the expent catholyte solution. This fourth conduit has a larger diameter than the third conduit because it must allow for the easy exit of the expent catholyte solution plus the cathodic gases produced on the metal electrode. The indentation 10 for mounting the cathode electrode and part of the separator is shown in this figure, too. Shown in this figure are also the four extensions or ears, with perforations 30 located at the corners of the catholyte compartment for the bolting system.

Figure 4:
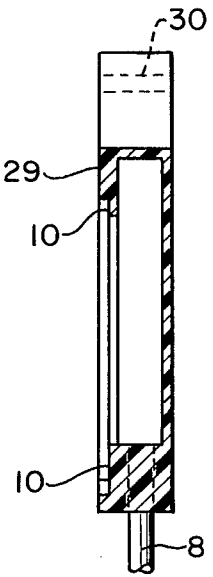
FIG. 4 is a cross section of the catholyte compartment through the line 4—4 in FIG. 3.

FIG. 4 presents a cross section of the catholyte compartment at the line marked 4—4 in FIG. 3. Here, the indentation 10, as in the anolyte compartment, is designed to hold the cathode electrode and part or the whole thickness of the separator. The position of the third conduit 8 is shown at the bottom of the figure with broken lines. The extension at the top of the catholyte compartment, and the perforations 30 for the bolting system are shown also with broken lines.

Figure 5:
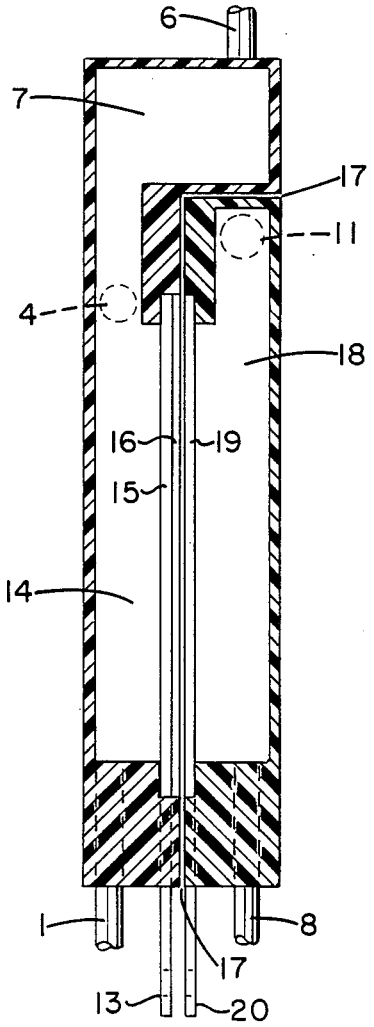
FIG. 5 is a cross section of the assembled cell with all its elements, as it could be seen through a plane 2—2 or 4—4 in FIGS. 1 and 3, respectively.

FIG. 5 illustrates a cross section of the plastic electrolytic cell with all its elements in position. At the bottom of the figure are the anode connection tab 13, the first conduit 1, the cathode electrode connection tab 20 and the third conduit 8. On the left side of this figure are shown the space between the anolyte and the catholyte compartment 17 with an elastomer adhesive or "in place gasket" substance used for sealing the cell during assembly, the space for the anolyte solution 14, the anode electrode 15, the separator 16, and the position that the second conduit 4 should occupy. At the top of the figure is shown the inlet 6. On the right of the FIG. 5 is shown the separation chamber 7, another portion of the space between the anolyte and catholyte compartment where the sealing compound is applied 17, the position of the third conduit 11, the space for the catholyte solution 18, and the cathode electrode 19.

Figure 6:
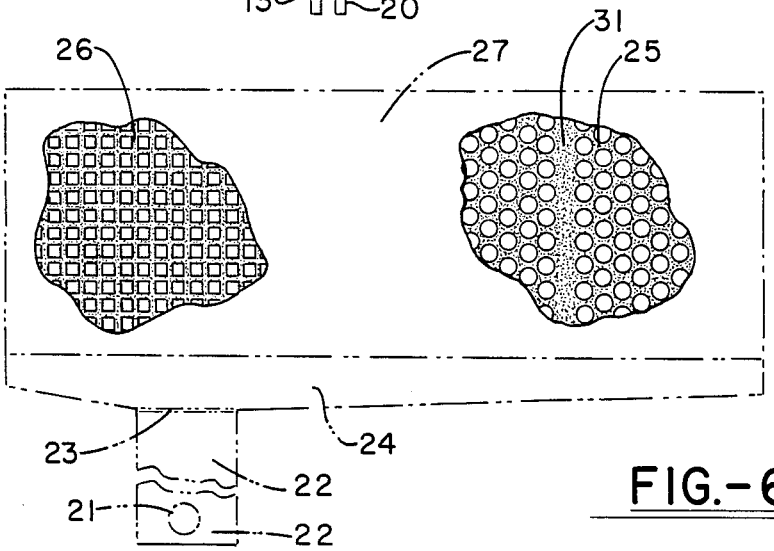
FIG. 6 presents the general configuration of the metal electrodes with the type of perforations recommended, the lower portion of the electrodes made of a solid sheet of the same metal, and the protruding connection tab.

The metal electrodes shown in FIG. 6 are generally made of an electrically conductive sheet of metal which is suitable for the particular electrochemical reaction to take place in the electrolytic cell. The electrodes may have an active coating or catalyst applied on their surfaces for facilitating the electrochemical reaction. FIG. 6 shows the general configuration for the metal electrodes used in the electrolytic cell of this invention. The active area of the electrode 27 is generally perforated for allowing the gases produced on the frontal, and opposing, surfaces of both electrodes to flow to the space located between the back of the electrodes and the internal walls of the catholyte and anolyte compartments identified as 18 and 14 respectively, and called the anolyte and the catholyte space. Two preferred possibilities of the type of perforations are shown in FIG. 6 one is the square perforations 26, where the length of the sides of the perforations are from 0.1 inches to four times the thickness of the metal electrodes. The recommended width of the metal between square perforations is between one to two times the thickness of the metal electrode. These square perforations have their sides parallel to the top and sides of the active area of the electrode. The reason for this alignment is to reduce the resistance to the flow of electricity from the connecting tab up to all of the active area by providing straight lines of conducting metal from the bottom to the top of the electrode.

Another possible configuration for the perforations is in the form of circular holes 25. The preferred perforation pattern is a closed package or triangular pitch. These circular perforations have diameters from 0.1 inches to four times the thickness of the metal electrode. When the circular perforations are used, it is important to include regions of solid electrode material thereon called conductive bands, shown as 31 in FIG. 6, to facilitate and equally distribute the flow of current from the bottom to all of the electrode active surface. The width and distance between these solid regions may change according to the overall dimensions of the electrodes, but the preferred width of the conductions bands is between two to three times the thickness of the metal electrode. The distance between conduction bands should be no greater than three inches. Welded at 23 to the lower solid portion of the electrodes 24 is a connecting tab 22 with a perforation 21 for connecting the electrode to the electrical power line.

These electrodes can be produced in an automated production line by: (a) punching the holes, according to any pre-design pattern, (b), cutting-off the shape of the electrode, including the solid portion at the bottom, (c) cutting the connecting tabs, and (d) welding the connecting tab, at 23, to the rest of the electrode as shown in FIG. 6.

The protruding tab is preferentially located as shown in FIG. 6, but could also be located at the ends and in alignment with the side of the electrodes. Other configurations are not excluded.

The main reason for the existence of perforated electrodes is the desire to provide the interelectrode gap with a way for the gases to exit this gap and thus reduce the electrical resistance in this interelectrode space. There have been many arguments in the past about the shape and form of these perforations. Some designs call for expanded metal, some use wire mesh configurations, some call for solid sheets of metal with no perforations at all and some use perforated holes of different diameters. It is believed that there has not been any rational criteria for selecting the diameter and configuration of the holes, except for empirical correlations made from the experience of each designer.

One of the main disadvantages of perforated electrodes is that, for a certain given geometrical surface, the real active surface of the metal electrode left is, because of these perforations, just a fraction of the original geometrical surface. To compensate for this loss, the real operating current density must be increased, with a consequent increase in the operating voltage and energy consumption. Another important consideration is the increase in electrical resistance inside the metal electrode because of the tortuous path for the electricity created by either expanding or by using wire mesh type electrodes.

The present invention offers solutions to the problems mentioned above.

Consider first the size and configuration of the perforations, when a round hole is punched in a metal sheet, a small area of the surface disappears, while a new one is created on the walls of the perforation. The area eliminated by a circular perforation can be expressed by:

$$A=\pi*\tfrac{1}{4}*(\text{diameter})\Lambda 2 \quad (1)$$

While the area of the newly created surface is given by:

$$B=\pi*\text{diameter}*\text{thickness} \quad (2)$$

However, not all of the newly created surface becomes an efficient current conductor (or active surface). Previous experiments reported in the literature have shown that the region carrying any significant current can be reduced up to a small fraction of the thickness of the metal, or the length of the perforation. Therefore, equation (2) must be modified to reflect this fact:

$$B(\text{effective})=b*\pi*\text{diameter}*\text{ thickness}, \quad (3)$$

where b is the fraction of the thickness of the metal electrode contributing with any significance to the electrochemical reaction.

By equating (1) and (2) we obtain:

$$*\tfrac{1}{4}*(\text{diameter})\Lambda 2=b*\pi*\text{diameter}*\text{thickness}, \quad (4)$$

or that:

$$\text{effective diameter}=4*\text{thickness}*b \quad (5)$$

Another factor to consider is that the size of the perforations must be such that they will allow the easy passage of the bubbles to the space behind the electrode. For all practical purposes, the minimum diameter size for the gas bubbles to pass is about 0.1 inches. Therefore, the effective diameter (D) of the circular perforations must be between 0.1 inches and four times the thickness of the metal electrode. Thus, if the metal electrode is 0.040 inches thick, the diameter of the perforation should be between 0.1 to 0.16 inches. The recommended distance between holes is, at least, equal to the thickness of the metal, ie. in this case, it will be equal to 0.040 in. or larger.

An alternative to the punched circular perforation is square-shaped perforations, with the the sides of the squares aligned parallel with the top border of the active area. In this case, similar considerations as mentioned for the circular perforations can be made here:

$$\text{area of a square of side } L=L*L \quad (6)$$

$$\text{effective area generated by punching} = 4*(L*Th*b) \quad (7)$$

where Th is the thickness of the electrode.
Therefore, the effective length of the square's side is:

$$L = 4*Th*b \quad (8)$$

which ends up being of the same form as equation (4). Therefore, the recommended effective length of the square's side is between 0.1 inches to four times the thickness of the metal electrode. The thickness of the metal electrode should be calculated according to existing principles of regular electrical engineering the minimize IR loses.

Since both the anolyte and catholyte compartments have their own independent electrolyte circulation, there is very little interchange of fluid across the separator as shown in FIG. 5. This separator is made preferentially, but not limited to, one of the following microporous plastic materials: (a) microporous CPVC, (b) microporous PVC, (c) microporous high density polyethylene, (d) microporous halocarbon materials that have their surface treated in such a way as to render them hydrophilic, (e) glass fiber mats, and (f) porous ceramics. Depending on the electrochemical reaction, the composition of the catholyte and anolyte solutions, and temperature, some other microporous plastic materials may be suitable for separators. In certain cases it will be possible to make a separator by joining together two sheets of different microporous materials, one resistant to the anolyte environment and the other resistant to the catholyte environment.

Porosity should be such as to prevent the passage of any gas bubbles, minimize interdiffusion of the anolyte and catholyte solutions to each other's compartments and, at the same time, offer the minimum electrical resistance. Available technology allows the production of microporous materials with pore diameters of less than 0.1 microns. The thickness of these separators should be such as to give a reasonable operational life of at least two years. In general this could be achieved, for microporous plastic materials as mentioned above, with thicknesses ranging from 0.004 to 0.06 inches. The separators should be of such overall dimensions as to cover the totality of the electrode's active area, plus the solid electrical distribution bar 24 at the bottom of the active electrode area, and part of the connective tab 22. The separator should be cut at about ¼ of an inch before reaching the border of the plastic body.

The cell subject of this invention could also use a membrane, as defined above.

The electrodes are attached to the indentations made into the plastic compartments, in the places numbered 3 and 10 in FIGS. 1 and 3 respectively, by the use of a resilient adhesive means that is chemically resistant to the cell's environment. As an example of such resilient adhesive means, silicon-based adhesives already existing in the market and manufactured by several companies, could be used. The use of this type of adhesive is preferred for four basic reasons: (a) to hold the electrodes and the separator to the two cell compartments, (b) to avoid leaking of fluid or gasses (because of its sealing-gasketing properties), (c) because of its elastomeric properties it allows for differences in the expansion coefficients of the plastic body and the metal electrodes, (d) ease of application and removal and (e) it can also be used to join together the cathode and anode compartments during final assembly.

Each of the two compartments, the anolyte and the catholyte, has four extensions or ears with openings or the bolts to pass through 12 and 30. One of the compartments, called the second compartment (it makes no difference which one), has the hole threaded, to serve as attachment for the bolt. The other compartment, called the first compartment, has an enlargement to hold the head of the bolt in such a way as to be flush with the overall back surface when in place. This system allows for easy stacking of several cells together for higher production rates. The recommended mounting procedure is as follows: (a) the regions numbered 3 in FIGS. 1 and 2 are filled with the resilient adhesive, (b) the electrode is pressed into place, (c) if necessary, more adhesive should be put on top of the electrode's borders to insure a good seal, and (d) before the adhesive is set, the diaphragm should be carefully pressed into place, in contact with the adhesive around its border, in such way as to cover all of the anode's surface and a portion of the protruding connecting tab 22, as mentioned above. The separator can be attached to either one of the cell's compartments in the same way as mentioned above.

Once both electrodes and the separator have been installed, the excess of adhesive should be removed in such a way as to not allow any projections over the plane formed by the front surface of the plastic anolyte and catholyte compartments. After this has been done, a sparse amount of fresh adhesive or other compounds generally known known as "forming in place gasketing material" is put onto the cathode and anode compartment's matching front surfaces 28 and 29, and the two parts pressed gently together. Once this is done, the four bolts are screwed into place and thus, the cell assembly is held together by the four bolts and the adhesive.

As an alternative to the bolting system, and depending on the economics, the two plastic parts of the body, i.e. the anolyte and the catholyte compartments, can be solvent-welded, or joined together, permanently, with a proper adhesive specific for the type of plastic material used to build there compartments. In this case the plastic cell does not need the four extensions with holes for the bolting system located on the corners of the compartments. When the operational life of the cell has been reached, at least two years depending on the life of the catalyst and/or the separator, the plastic body could be broken and discarded and the metal electrodes reconditioned for subsequent use.

OPERATION

The cell of this invention will preferentially operate with a separator as mentioned above.

By way of example, the plastic cell may produce chlorine, hydrogen and caustic soda. However, this example should not be taken as a limitation for the applications of the plastic electrolytic cell.

First, the operator should choose the operating current density necessary to achieve the desired overall production rate of chlorine gas. Once this parameter is known the flow rates of both the catholyte and anolyte solutions should be regulated in such a way as to be between 5 to 10 times the gas flow rate (measured as volume of gas/sec) and the desired concentration of caustic soda to be produced.

Once the electrolyte solutions are flowing and no leaks are observed, the electrical power to the electrolytic cell is connected. After the process of electrolysis starts, the installation should be checked for leaks. These checks should be repeated periodically. Because each of the compartments has an independent flow of electrolyte and discharge of gases, very little mixing of catholyte and anolyte solutions should occur. To verify that the separator is working properly, the expent brine and the caustic produced should be periodically checked for hypochlorites and salt impurities respectively. This provision will result in the following advantages. A negligible amount of salt will diffuse to the catholyte compartment. This situation will result in big savings in the evaporation-separation stage, if this stage is part of the overall process. In any case, the caustic produced will have very little amount of salt in it, and could be used directly in some of those applications where caustic with low salt concentration is required. Since, practically, there is no fluid flow between the two compartments, no significant amount of chlorine will pass to the cathode compartment and therefore, no formation of highly corrosive species like hypochlorites and/or chlorates will be formed. In those cases where the chlorine, or any other anodic gases, is aspirated from the separation chamber and injected into a water stream and the expent brine returned to a resaturation tank, it may be very useful to connect the top (liquid free) part of the tank to the inlet on top of the separation chamber. This operation will remove the chlorine fumes from the resaturation tank and thus reduce the problems that originate during the replacement of salt in the tank. If this method is not used a certain amount of chlorine gas could be released to the environment.

Presently, most of the electrolytic cells available for industrial production of chlorine and caustic soda are designed and constructed with either a "monopolar" or "bipolar" configuration. These configurations do not render much flexibility in the way cells are "stacked" together to form large production units. Some of these problems are discussed by Mose et al in U.S. Pat. No. 4,263,119. Because each of the cells of this invention are fully operational by themselves and their compartments are electrically non-conductive, they can be stacked in in parallel or in series. What is also very important is the fact that this configuration can be changed in the future without need to make changes in the cell stack or its support structure.

Because each cell is fully operational by itself and their compartments are made of impervious, electrically non conductive plastic, the stack of cells can be put together without the need of high compression devices. This feature also allows for the easy replacement of any cell in the stack without having to shut down the other cells in the stack and therefore reduces possible production losses and maintenance costs.

Because each cell is fully operational by itself, the stack of cells and the cells in a stack could be connected in such a way as to adapt to the electrical power source available. This characteristic becomes very important if, for any reason, the power source must be replaced in the future.

Thus it can be seen that the objects of the invention have been satisfied by the structure presented hereinabove. While in accordance with the Patent Statutes only the best modes and preferred embodiments of the invention have been presented and described in detail, the invention is not limited thereto or thereby. Accordingly, for an appreciation of the true scope and breath of the invention, reference should be made to the appended claims.

I claim:

1. An improved electrolytic cell of the type having a catholyte compartment, an anolyte compartment, a flat cathode electrode, a flat anode electrode, and a separator located between the anode and the cathode electrodes, wherein the improvement comprises:

(a) a separation chamber located at the top and being an integral part of said anolyte compartment crossing a separator plane between said anode and cathode compartments to occupy a space available over said catholyte compartment and being flush to a plane of a back surface of said catholyte compartment to separate gas produced during the electrolysis from expent anolyte solution, and having at least one outlet for removal of anodic gases produced during electrolysis, and at least one inlet for receiving gases originated from outside of said electrolytic cell.

2. The improvements in an electrolytic cell as recited in claim 1, further comprising:

a first conduit for receiving a flow of fresh anolyte solution into said anolyte compartment located at the bottom and next to one of the lateral sides of said anolyte compartment, and a second conduit for removing expent anolyte solution from said anolyte compartment located on a lateral side to said anolyte compartment and on the opposite side to said first conduit and at a level immediately above and parallel to a level corresponding to the top side of the anode electrode.

3. The improvements in an electrolytic cell as recited in claim 1, further comprising:

a third conduit for receiving a flow of fresh catholyte feeding solution into said catholyte compartment located in the bottom and next to the side of said catholyte compartment and in opposition to said first conduit located in the anolyte compartment, and a fourth conduit for removing the fluid product of the cathode electrode reaction located on a lateral side of said catholyte compartment and on an opposite side the said third conduit and at a level immediately above and parallel to a level corresponding to the top side of the cathode electrode.

4. The improvement in an electrolytic cell as recited in claim 1, wherein said separator is an asbestos-based material.

5. The improvement in an electrolytic cell as recited in claim 1, wherein said separator is made of microporous plastic materials.

6. The improvement in an electrolytic cell as recited in claim 5, wherein the separator is made by joining together two layers of different microporous materials 7. The improvements in an electrolytic cell as recited in claim 1, wherein:

said anode electrode and cathode electrode have in their active surface a multiplicity of perforations for allowing gases produced on frontal surfaces of the electrodes to flow to the space located between the back of said electrodes and internal walls of the anolyte and catholyte compartments, and where a lower portion of said electrode is a solid sheet of the same metal to which a protruding connection tab is welded.

8. The improvement in an electrolytic cell as recited in claim 7 where the perforations made in the metal electrodes are circular with a diameter size from 0.07 inches to four times the thickness of the metal electrode.

9. the improvement in an electrolytic cell as recited in claim 7, where said circular perforations are spaced by conduction bands between 0.08 to 0.24 inches wide, located parallel to the sides of an active area and extending from a lower solid sheet portion to the top of the electrode active area, and with a separation between conduction bands from 2 to 4 inches.

10. The improvement in an electrolytic cell as recited in claim 7, where said electrodes have square perforations for allowing gases produced on the frontal surfaces of the electrodes to flow to the space located between the back of the electrodes and the internal walls of said anolyte and catholyte compartments, and where the length of the perforation's sides are from 0.07 inches to four times as long as the thickness of said electrode, and where the sides are aligned parallel to the top and lateral sides of the active area of the electrode.

11. The improvement in an electrolytic cell as recited in claim 7, where said anode electrode has perforations of different shape from those of said cathode electrode.

12. The improvement in an electrolytic cell as recited in claim 7, where a lower portion of the electrodes is a solid sheet of the same metal to which a protruding connection tab is welded.

* * * * *